US006229768B1

(12) United States Patent
Nakazawa et al.

(10) Patent No.: US 6,229,768 B1
(45) Date of Patent: May 8, 2001

(54) TRICK ACTION TYPE CLOCK

(75) Inventors: Hiroyuki Nakazawa, Chiba; Hiroshi Ito, Saitama, both of (JP)

(73) Assignee: Rhythm Watch Co., Ltd., Tokyo (JP)

( * ) Notice: Subject to any disclaimer, the term of this patent is extended or adjusted under 35 U.S.C. 154(b) by 0 days.

(21) Appl. No.: 09/238,414

(22) Filed: Jan. 28, 1999

(51) Int. Cl.[7] ..... G04B 19/00

(52) U.S. Cl. ..... 368/223; 368/228; 368/233; 368/285

(58) Field of Search ..... 368/88, 77, 276, 368/285, 223, 228, 232, 233, 272–273

(56) References Cited

U.S. PATENT DOCUMENTS 3,444,685 * 5/1969 Juillerat ..... 368/285
4,941,137 * 7/1990 Kikuchi ..... 368/223
5,161,130 * 11/1992 Sato et al. ..... 368/285

FOREIGN PATENT DOCUMENTS 8-10256 1/1996 (JP) .
8-68870 3/1996 (JP) .

* cited by examiner

*Primary Examiner*—Vit Miska
(74) *Attorney, Agent, or Firm*—Arent Fox Kintner Plotkin & Kahn, PLLC

(57) ABSTRACT

A trick action type clock, wherein a dial plate which is arranged in front of ornaments is made of left and right side dial plates mating along a line passing through a center of rotation of the hands. A planetary gear mechanism actuates the left and right side dial plates so as to make them rotate and revolve around the center of rotation of the hands to produce an opening and closing motion. Therefore, the dial plate made of the two mating parts performs an opening and closing motion which produces a strong impression due to the surprising dynamic change.

4 Claims, 15 Drawing Sheets

TRICK ACTION TYPE CLOCK

BACKGROUND OF THE INVENTION

1. Field of the Invention

The present invention relates to a trick action type clock, more particularly relates to a trick action type clock which moves a dial plate etc. at a predetermined time to make a figurine or other ornament behind the dial plate appear.

2. Description of the Related Art

Trick action type clocks where the dial plate is composed of a plurality of parts and where when a predetermined time, for example, 12 noon, arrives, the plurality of parts are moved so as to separate from each other, a figurine or other ornament installed behind the dial plate is made to appear, and the ornament is made to move in time with music have been developed and marketed.

Such clocks are disclosed in the Japanese Examined Patent Publication (Kokoku) No. 8-10256 and Japanese Unexamined Patent Publication (Kokai) No. 8-68870. The clock disclosed in the Japanese Examined Patent Publication (Kokoku) No. 8-10256 has a dial plate comprised of a plurality of fan-shaped parts. When a predetermined time arrives, these dial plate parts rotate to form a petal configuration and, as a result, a figurine or other ornament installed behind the dial plate can be seen. The mechanism which drives the parts is comprised of a ring-shaped rack formed with gear teeth at its circumference and a plurality of pinions which are arranged outside of the ring-shaped rack in the radial direction and engage with the ring-shaped rack. The dial plate parts are fixed to the shafts of the plurality of pinions and rotate to the opening or closing position when the ring-shaped rack is driven by a motor.

On the other hand, the clock disclosed in the Japanese Unexamined Patent Publication (Kokai) No. 8-68870 has a dial plate which can split into two parts in the vertical direction. When a predetermined time arrives, the dial plate splits into two parts in the vertical direction and a figurine or other ornament installed behind the dial plate appears.

These clocks have problems, however. In the clock disclosed in the Japanese Examined Patent Publication (Kokoku) No. 8-10256, since the drive mechanism for moving the dial plate parts consists of a ring-shaped rack with gear teeth at its circumference and of a plurality of pinions arranged outside of the ring-shaped rack in the radial direction and engaging with the ring-shaped rack is adopted, there is the problem that the overall dimensions of clock and the number of parts become large.

Further, there is the problem that the dial plate parts rotated to the open position are only supported by their corresponding shafts, therefore the parts loosely rattle forward and backward.

Furthermore, there is the problem that the parts forming the dial plate can only move by rotating about their own fixed shafts, therefore the movement of the parts is not so striking and therefore the clock is somewhat lacking in impact from the standpoint of the surprise of the dynamic change.

In the clock disclosed in Japanese Unexamined Patent Publication (Kokai) No. 8-68870, on the other hand, there is the problem that two parts forming the dial plate only move upward and downward. Therefore, even though the clock can make the ornament hidden inside appear, the clock does not produce such a strong impact in terms of the change of its appearance and, like the above case, is poor in terms of the surprise of the change.

SUMMARY OF THE INVENTION

It is therefore an object of the present invention to provide a trick action type clock which is mechanically simple and comprised of a small number of parts yet which can produce a strong impact through the change of a dial plate or other cover concealing an ornament etc.

It is another object of the present invention to provide a trick action type clock having a dial plate or other cover concealing an ornament which can be kept stable when opening or closing it.

To achieve the above-mentioned objects, according to a first aspect of the present invention, there is provided a trick action type clock comprising a dial plate; long and short hands; a movement for moving the hands; a cover formed by a plurality of parts mating along a line passing through a predetermined axis and arranged so as to be openable from and closeable to the predetermined axis; and a drive means for driving the cover parts so as to make the parts rotate and make them revolve around the predetermined axis to produce the opening and closing motion.

Due to the above configuration, when a predetermined time, for example, 12 noon, arrives, the drive means drives the cover so that the parts engage in an opening and closing motion while rotating and revolving around the predetermined axis.

In the above configuration, the drive means may be formed by a sun gear fixed immovably on a housing coaxially with the predetermined axis; a plurality of planetary gears engaging with the sun gear; a plurality of connection members fixed to the centers of rotation of the planetary gears at one end and rotatably connected to the cover parts at the other ends away from the centers of rotation; a support member arranged rotatably on the predetermined axis and supporting the planetary gears rotatably; and a drive motor for making the support member rotate on the predetermined axis.

In such a configuration, when the support member is rotated by the drive motor, the planetary gears engaged with the sun gear revolve around the sun gear while rotating, the connection members rotate with the planetary gears, and the cover parts connected to the connection members rotate and revolve around the center of rotation of the support member to perform an opening and closing motion.

Further, the clock may include a plurality of ornaments arranged behind the cover and a plurality of ornament-use gears engaging with the sun gear and rotatably supported on the support member for moving the ornaments.

In such a configuration, the cover performs the opening and closing motion as described above to make the ornaments concealed behind it appear and the rotation of the support member makes the ornament-use gears rotate and revolve around the center of rotation of the support member, whereby the ornaments rotate and revolve around the predetermined axis.

Further, the connection members may be crank-shaped members having step differences in the direction of the predetermined axis.

Further, to achieve the above-mentioned objects, according to a second aspect of the present invention, there is provided a trick action type clock comprising long and short hands; a movement for moving the hands; a dial plate formed by a plurality of parts mating along a line passing through a center of rotation of the hands and arranged so as to be openable from and closeable to the center of rotation; and a drive means for driving the dial plate parts to make the parts rotate and revolve around the center of rotation to produce an opening and closing motion.

In the above configuration, when a predetermined time, for example, 12 noon, arrives, the drive means drives the dial plate so that the parts engage in an opening and closing motion while rotating and revolving around the center of rotation.

Further, the drive means may be formed by a sun gear immovably fixed on a housing coaxially with the center of rotation; a plurality of planetary gears engaging with the sun gear; a plurality of connection members fixed to the centers of rotation of the planetary gears at one end and rotatably connected to the dial plate parts at the other end away from the centers of rotation; a support member arranged rotatably on the center of rotation and supporting the planetary gears rotatably; and a drive motor for making the support member rotate on the center of rotation.

In such a configuration, when the support member is rotated by the drive motor, the planetary gears engaged with the sun gear revolve around the sun gear while rotating, the connection members rotate with the planetary gears, and the dial plate parts connected to the connection members rotate and revolve around the center of rotation of the support member to perform an opening and closing motion.

Further, the clock may include a plurality of ornaments arranged behind the dial plate and a plurality of ornament-use gears engaging with the sun gear and rotatably supported on the support member for moving the ornaments.

In such a configuration, the dial plate performs the opening and closing motion as described above to make the ornaments concealed behind it appear and the rotation of the support member makes the ornament-use gears rotate and revolve around the center of rotation of the support member, whereby the ornaments rotate and revolve around the center of rotation.

Further, the connection members may be crank-shaped members having step differences in the direction of the center of rotation.

BRIEF DESCRIPTION OF THE DRAWINGS

The above and other objects and features of the present invention will be better understood from the following description given with reference to the accompanying drawings in which.

DESCRIPTION OF THE PREFERRED EMBODIMENTS

Below, preferred embodiments of a trick action type clock of the present invention will be described with reference to the accompanying drawings.

Figure 1:
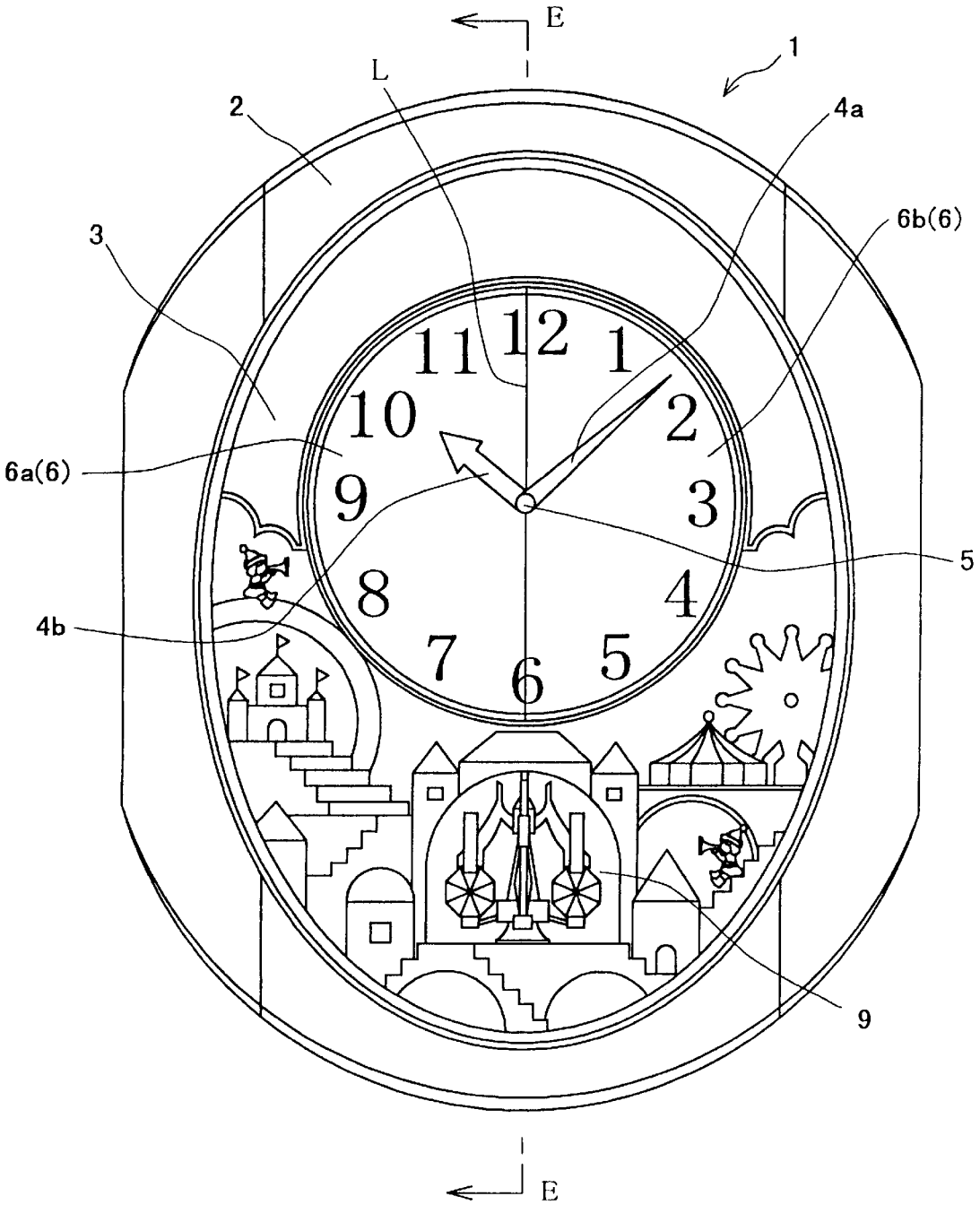
FIG. 1 is a front view of a trick action type clock of the present invention.
Figure 2:
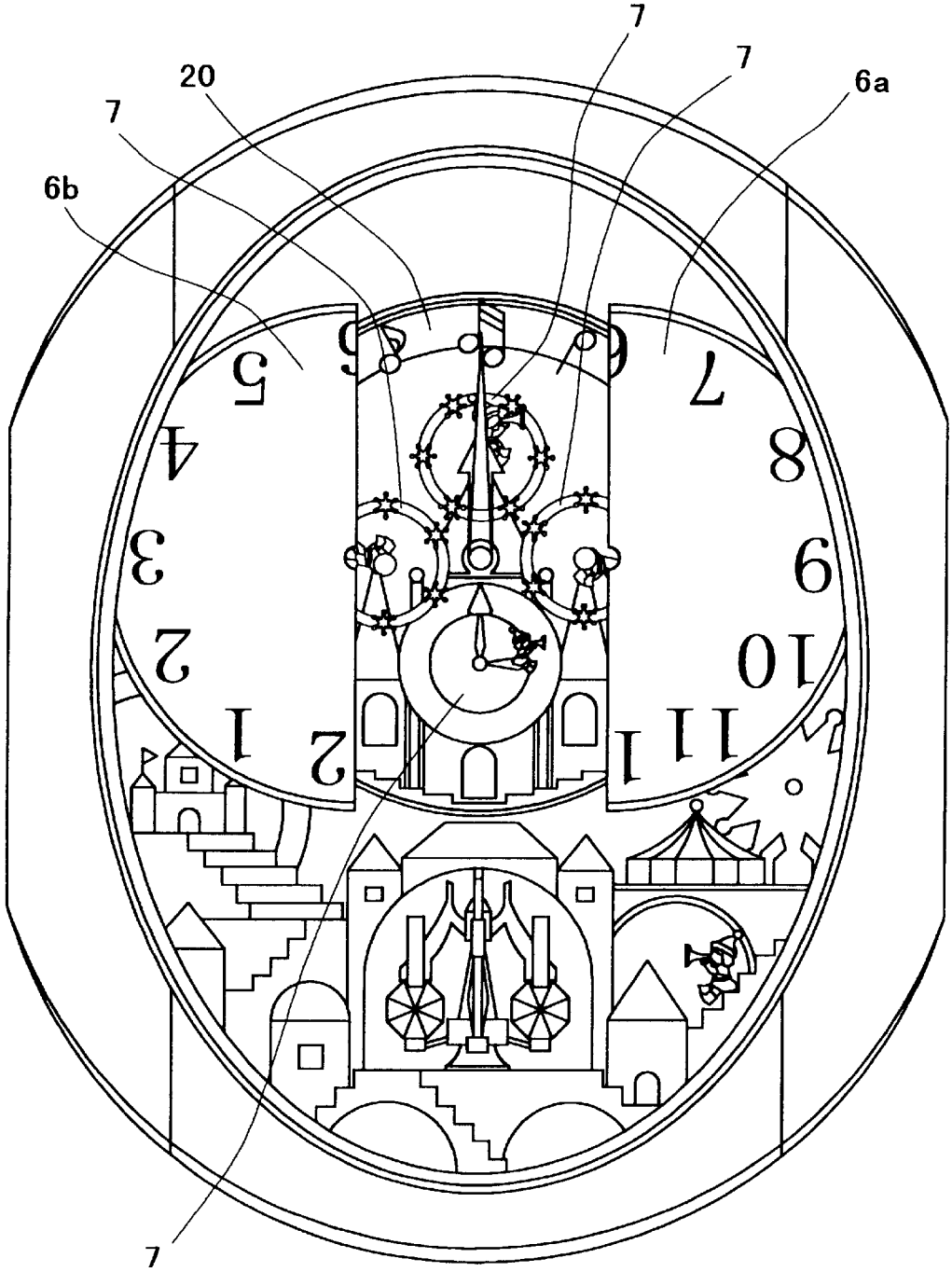
FIG. 2 is a front view of the trick action type clock of the present invention in the state with the dial plate opened.
Figure 3:
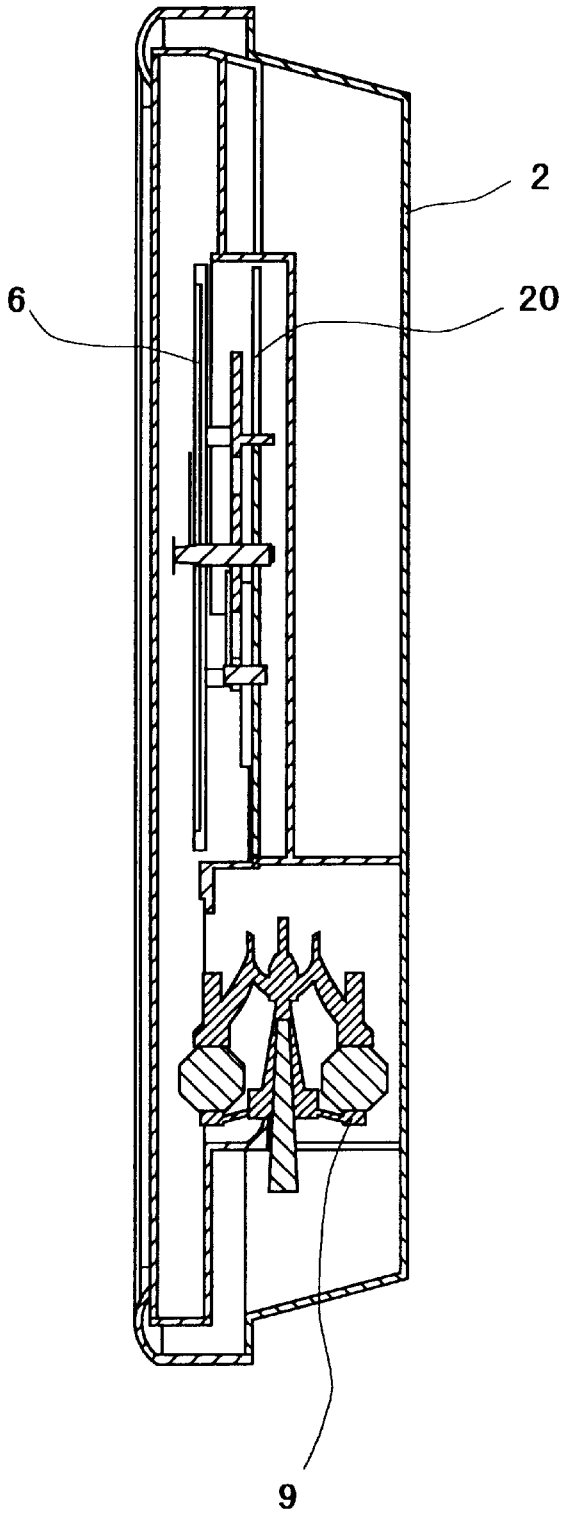
FIG. 3 is a vertical sectional view taken along a line E—E of FIG. 1.

FIGS. 1 to 3 show a trick action type clock according to one embodiment of the present invention. FIG. 1 is a front view of the clock, while FIG. 2 is a front view showing the state where the dial plate has split and rotated and revolved through an angle of 180 degrees by a drive means, described later. FIG. 3 is a vertical sectional view taken along a line E—E of FIG. 1. The trick action clock 1 according to this embodiment has a housing 2 defining an outside profile; a glass face 3 covering the front portion of the housing 2; a dial plate 6 comprised of, as parts forming a cover, a left dial plate 6*a* and a right dial plate 6*b* mating along a line L passing through a predetermined axis, namely, the shaft 5 (i.e., the center of rotation) of a long hand (minute hand) 4*a* and a short hand (hour hand) 4*b*; ornaments 7 installed behind the dial plate 6; a rotating disk 20 as a rotator or support member located behind the ornaments 7; a rotating ornament 9 located under the dial plate 6 and rotating on a vertical axis; a drive means (not shown) for making the left and right side dial plates 6*a* and 6*b* rotate and revolve around the shaft 5 to perform an opening and closing motion; and a movement (not shown) for moving the long hand 4*a* and the short hand 4*b*, as basic components.

Figure 4:
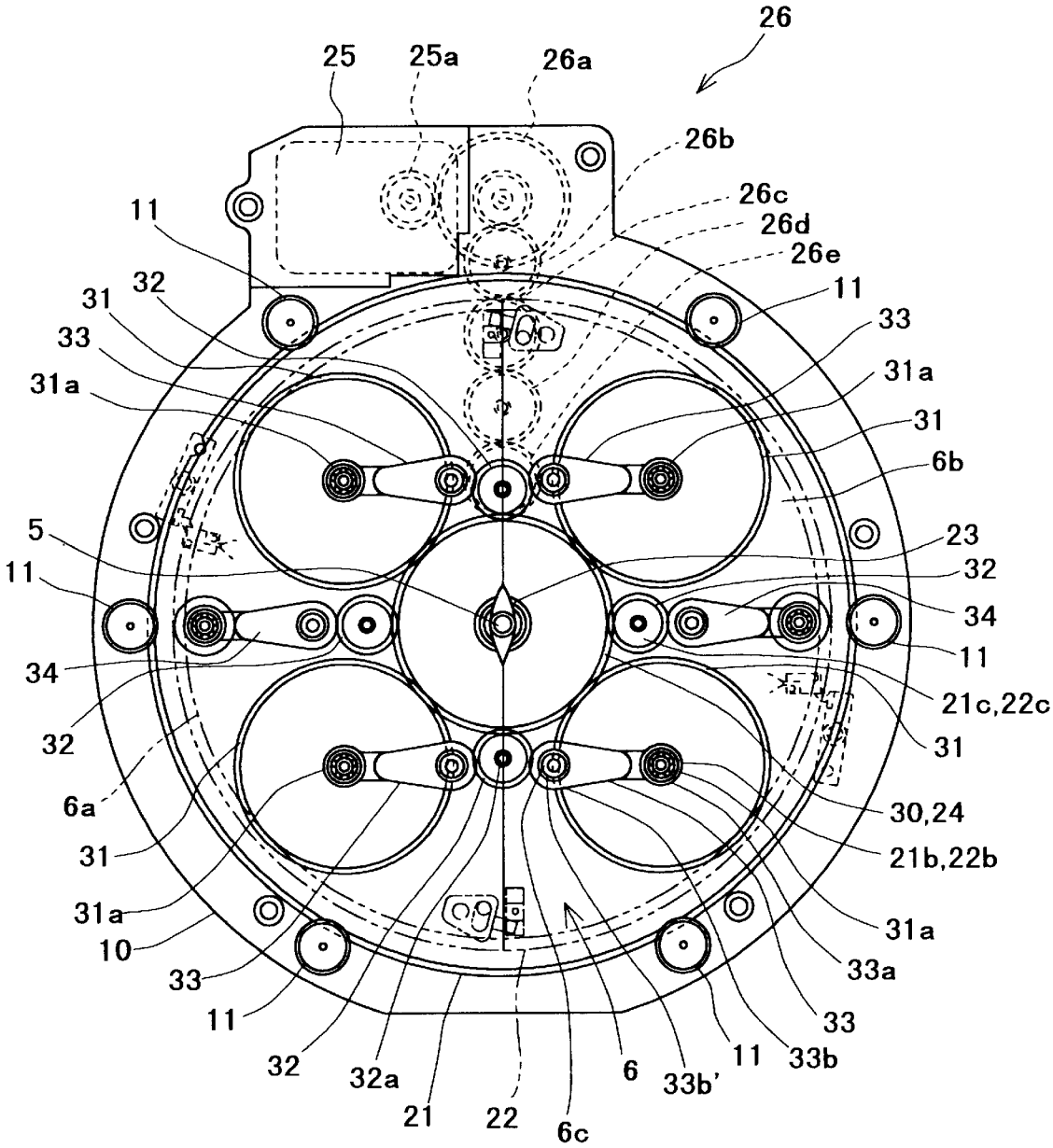
FIG. 4 is a schematic view of the configuration showing a drive means in the trick action type clock of the present invention.
Figure 5:
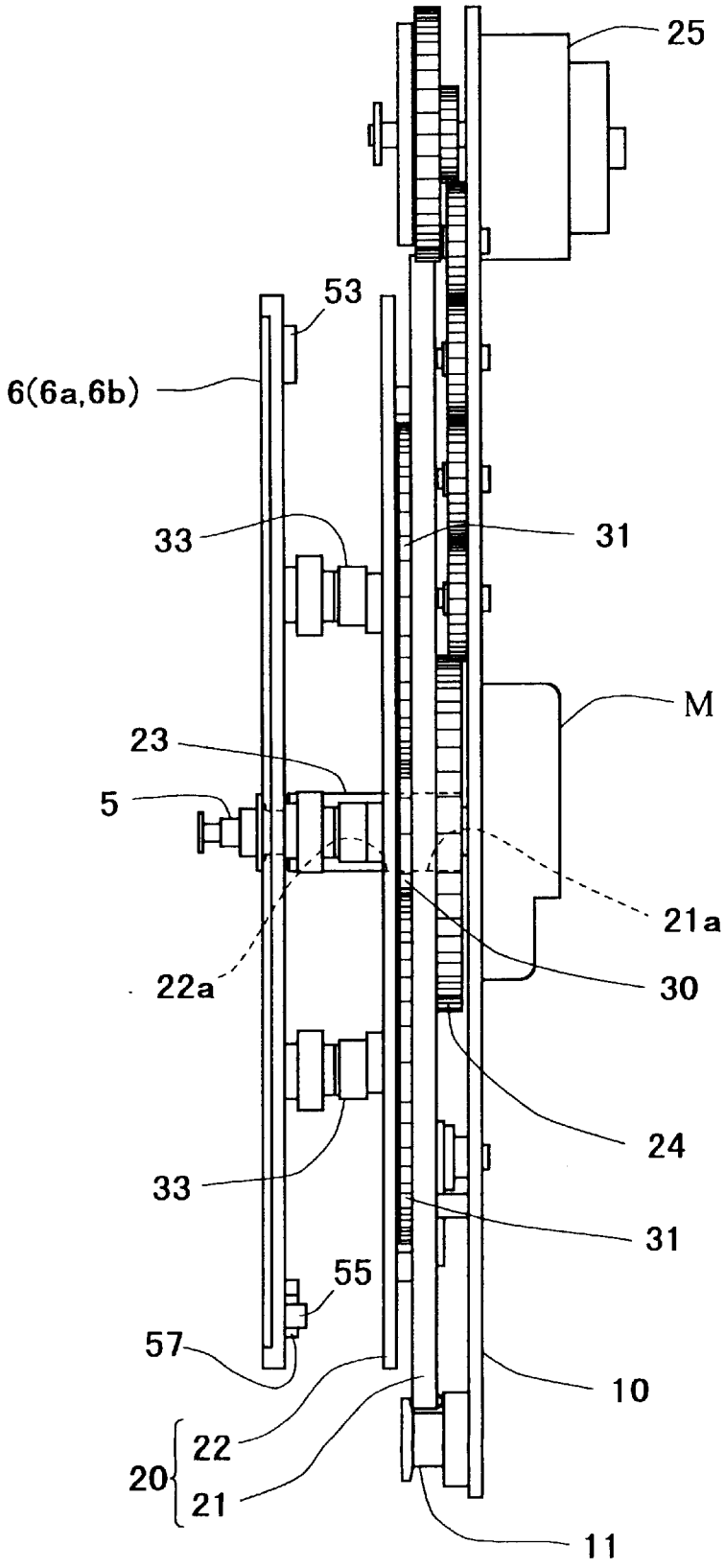
FIG. 5 is a right side view of the drive means shown in FIG. 4.
Figure 6:
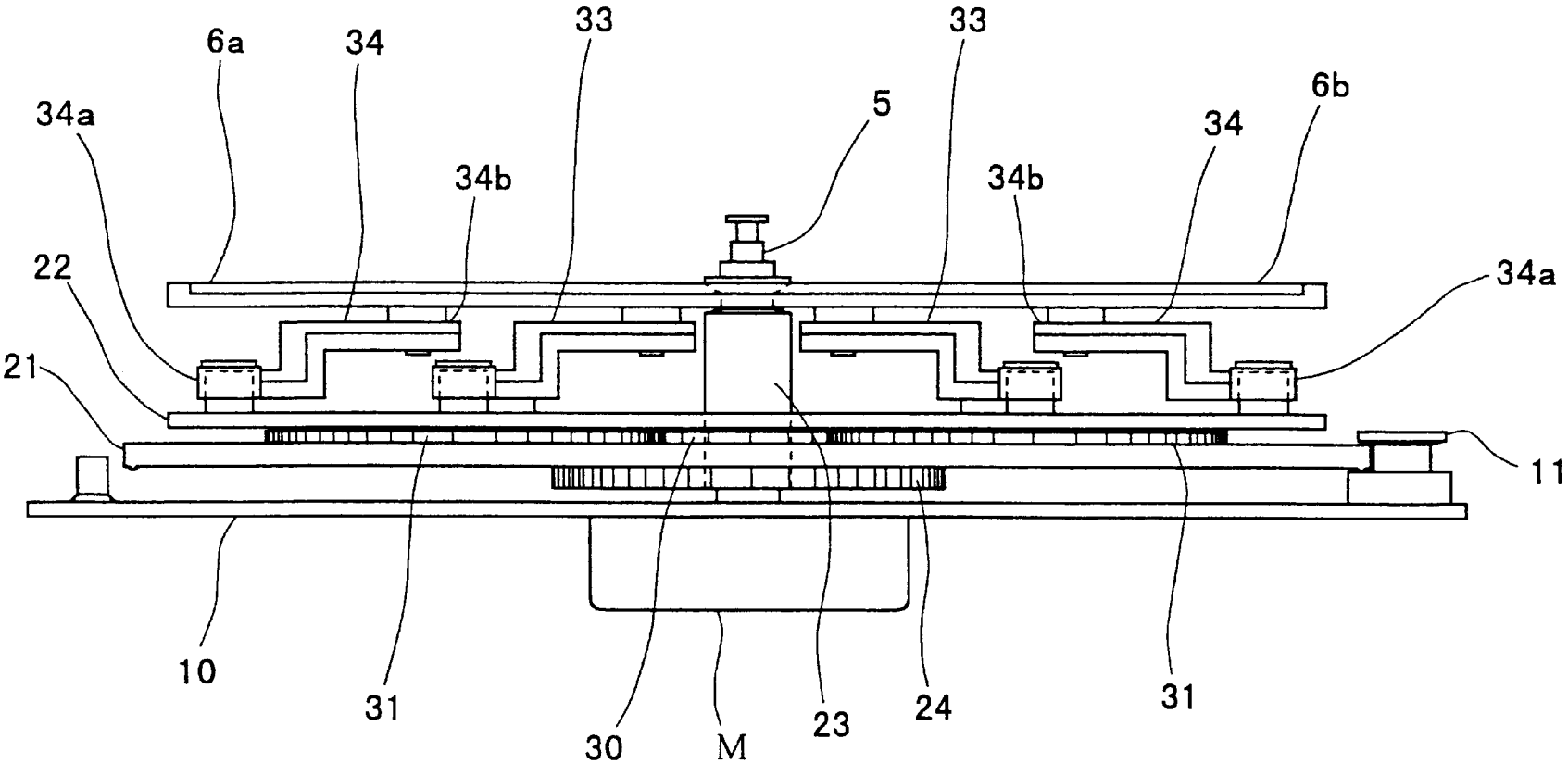
FIG. 6 is a bottom view of the drive means shown in FIG. 4.

At the rear side of the housing 2, as shown in FIGS. 4 to 6, is arranged a fixed disk 10 fixed to the housing 2. In front of the fixed disk 10 is arranged, at a predetermined clearance, a circular rotating disk 20 acting as a support member. The rotating disk 20 is comprised of a first rotating disk 21 located at the fixed disk 10 side and a second rotating disk 22 arranged concentrically with the first rotating disk 21 a predetermined distance therefrom and connected to the first rotating disk 21 so as to rotate therewith.

The first and second rotating disks 21 and 22 are fitted over a cylindrical pipe 23 at their center apertures 21*a* and 22*a* and are designed to rotate around the cylindrical pipe 23. The cylindrical pipe 23 is firmly fitted to the fixed disk 10 so as to project from the front face thereof and guides the shaft 5 of the hands 4 (4*a* and 4*b*). Further, on the rear face of the first rotating disk 21, a driven gear 24 is coaxially fixed with the shaft of the first rotating disk 21. The driven gear 24 is driven by a motor 25, one of a drive means arranged on the rear face of the fixed disk 10, by way of a drive gear 25*a* fixed to the spindle of the motor 25 and a gear train 26 consisting of a double-gear 26*a* and pinions 26*b* to 26*e*. That is, the operation of the motor 25 allows the first and second rotating disks 21 and 22 to rotate coaxially with the shaft 5 of the hands 4. Further, rollers 11 rotatably mounted on the fixed disk 10 support the outer peripheral edge of the first rotating disk 21 and allow the first rotating disk 21 to rotate smoothly. Furthermore, a movement M which is secured on the rear face of the fixed disk 10 is arranged at the rear end of the shaft 5 inserted into the cylindrical pipe 23. The movement M controls the motion of the hands 4.

Between the first rotating disk 21 and the second rotating disk 22 is arranged a sun gear 30 which is fitted over the cylindrical pipe 23 and fixed immovably. Four planetary gears 31 are arranged at equal intervals in the circumferential direction so as to engage with the sun gear 30. Shafts 31*a* formed at the center portions of the planetary gears 31 are inserted into bearing holes 21*b* and 22*b* formed on the first and second rotating disks 21 and 22 to be rotatably supported thereby. Further, between the planetary gears 31 are arranged four ornament-use gears 32 so as to engage with the sun gear 30. Shafts 32*a* formed at the center portions of the ornament-use gears 32 are inserted into bearing holes 21*c* and 22*c* formed in the first and second rotating disks 21 and 22 to be rotatably supported thereby.

The end portions of the shafts 31*a* of the planetary gears 31 project from the front face of the second rotating disk 22. One end 33*a* of a crank member 33 serving as a connection member which has a step difference in the axial direction of the shaft 5 is fixed to the end portion of each shaft 31*a*. On the other hand, the other end 33*b* of the crank member 33 is formed as an annular portion having a connection hole 33*b*'. The connection hole 33*b*' is fitted to a column-shaped shaft 6*c* which is formed on the left or right side dial plate 6*a* or 6*b* so as to project from the rear face thereof, whereby the crank member 33 is rotatably connected to the dial plate 6.

In the closed state where the left and right side dial plates 6*a* and 6*b* mate with each other, as shown in FIG. 2, four crank members 33 are arranged so as to be adjacent at the other ends 33*b* and so as to be aligned.

In the above case, the drive means, which drives the left and right side dial plates 6*a* and 6*b* forming the dial plate 6 serving as the cover so as to make them perform an opening and closing motion while making them rotate and revolve around the shaft 5, is composed of the sun gear 30 fixed immovably to the housing 2; the planetary gears 31 engaging with the sun gear 30; the crank members 33 with one ends fixed to the shafts 31*a*, namely the centers of rotation of the planetary gears 31, and with other ends rotatably connected to the left and right side dial plates 6*a* and 6*b*, namely, the dial plate parts, at positions away from the shafts 31*a*; the rotating disk 20 consisting of the first and second rotating disks 21 and 22; the motor 25; the drive gear 25*a*; the gear train 26; the driven gear 24; and so on.

Further, as shown in FIGS. 4 and 6, between the second rotating disk 22 and the left and right side dial plates 6*a* and 6*b* are arranged two crank members 34 serving as restraining means, or a second connection member, which prevent the left and right side dial plates 6*a*, 6*b* from shaking in the axial direction of the shaft 5. The two crank members 34 are arranged symmetrically about the line L and so as to be adjacent to each other at each other end 34*b* in the closed state where the left side dial plate 6*a* is mated with the right side dial plate 6*b*. Further, one ends 34*a* of the crank members 34 are rotatably connected to the first rotating disk 21 and second rotating disk 22, and the other ends 34*b* of the crank members 34 are rotatably connected to the left side dial plate 6*a* and the right side dial plate 6*b*.

The second crank members 34 described above prevent the left and right side dial plates 6*a* and 6*b* from shaking, particularly in the opened state.

Figure 7:
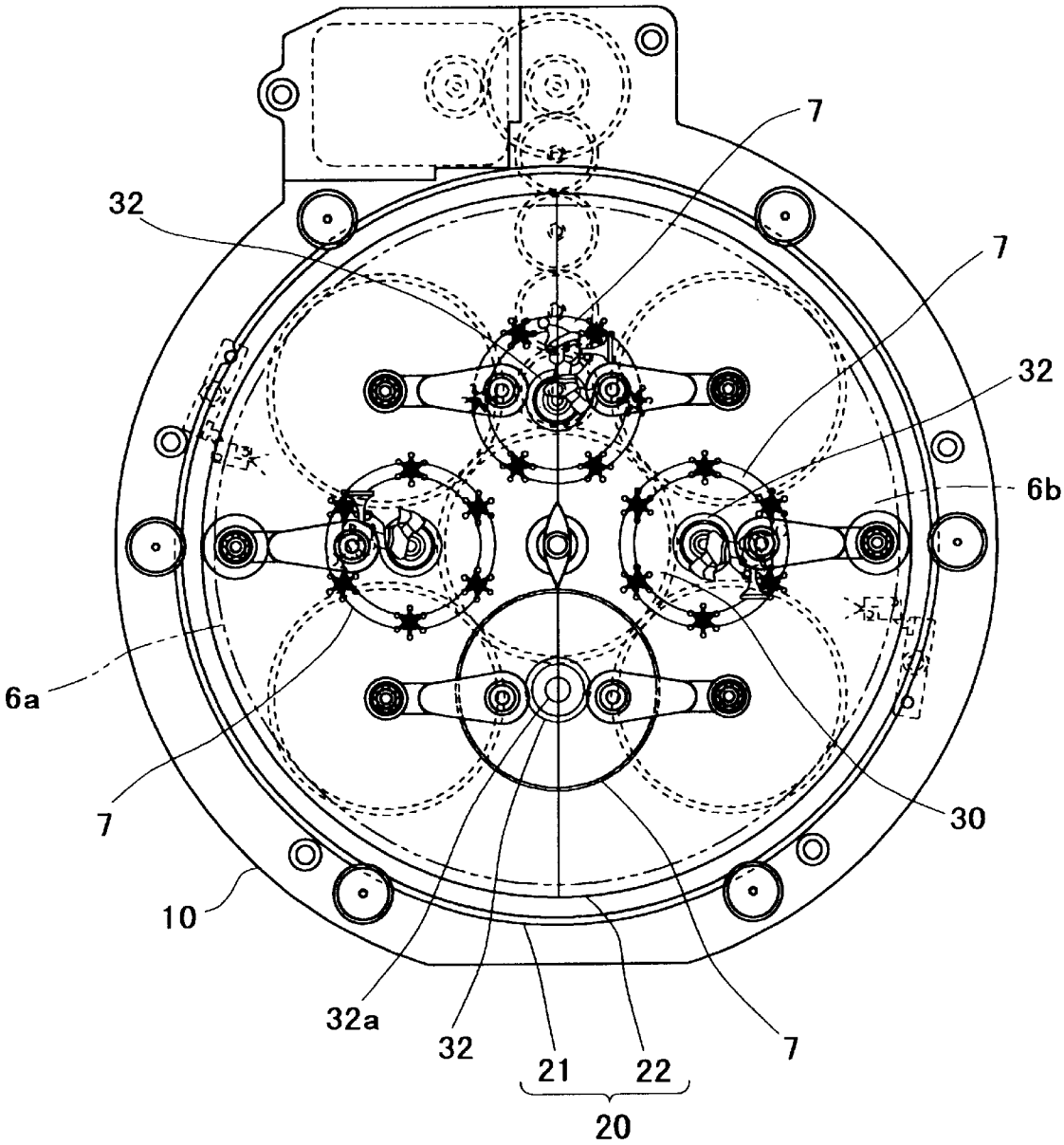
FIG. 7 is a front view showing an ornament of the trick action type clock of the present invention.

Further, as shown in FIG. 7, four substantially circular, variously decorated ornaments 7 are arranged between the second rotating disk 22 and the left and right side dial plates 6*a* and 6*b*. The ornaments 7 are fixed to the shafts 32*a* on the ornament-use gears 32, namely, to end portions of the shafts 32*a* which project from the front face of the second rotating disk 22. Therefore, when the rotating disk 20 (21 and 22) is rotated by the motor 25, the ornament-use gears 32 rotate and revolve around the shaft 5, whereby the ornaments 7 rotate and revolve around the shaft 5.

In arranging the ornaments 7, the adoption of the crank members 33 which connect the planetary gears 31 to the dial plate 6 or of the second crank members 34 which prevent the dial plate 6 from shaking enables enough space to be secured between the dial plate 6 and the second rotating disk 22. The ornaments 7 can be easily arranged at predetermined positions in this space.

Figure 8:
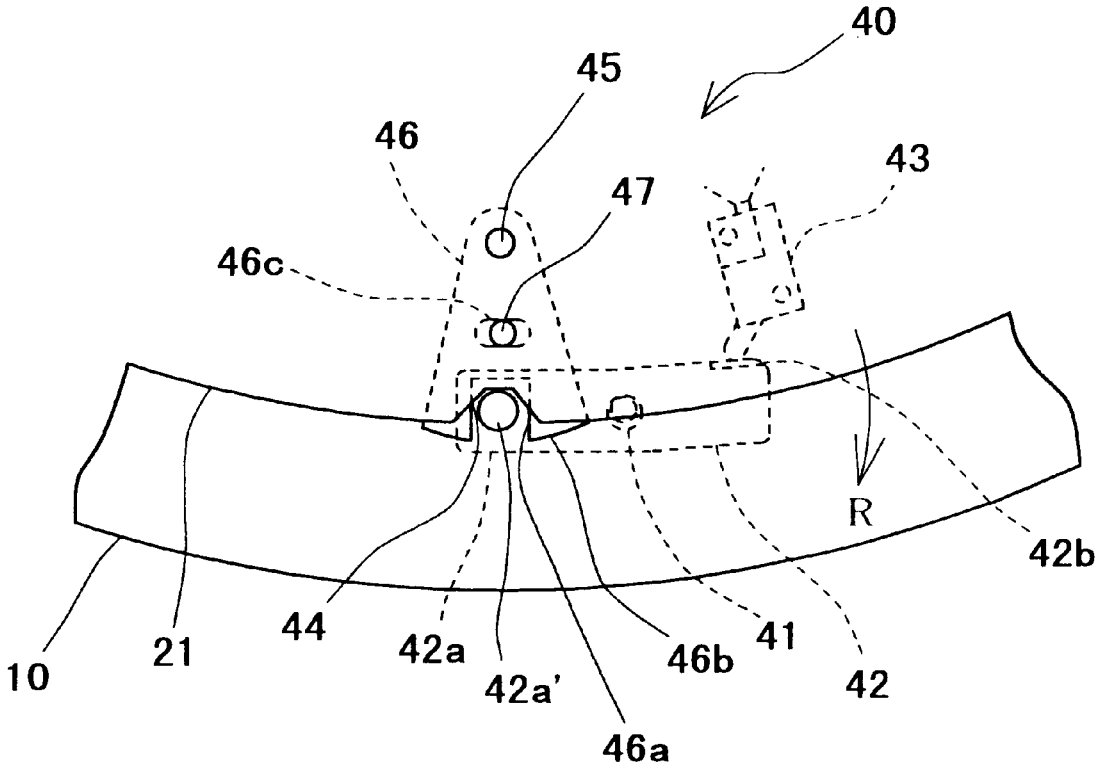
FIG. 8 is a front view showing a detecting means of the trick action type clock of the present invention.

As shown in FIG. 8, at the outer peripheral region of the rear face of the fixed disk 10, a swing arm 42 is swingably arranged on a support shaft 41 secured to the fixed disk 10. One end 42*a* of this is provided with a contact pin 42*a*' passing through an opening (not shown) formed in the fixed disk 10 and extending in front of the first rotating disk 21. The other end 42*b* is formed so as to be able to come in contact with a switch 43 secured on the fixed disk 10.

Further, at the outer peripheral region of the first rotating disk 21 is formed a tapered concavity 44 as a contact portion which spreads outward in the radial direction. In the closed state where the left side dial plate 6*a* is mated with the right side dial plate 6*b*, the contact pin 42*a*' enters the concavity 44. That is, when the swing arm 42 swings in the R direction, the other end 42*b* separates from the switch 43 or the pressure by the other end 42*b* decreases, and, as a result, the switch 43 is turned off to stop the operation of the motor 25. On the other hand, when the swing arm 42 swings in the reverse direction, the other end 42*b* comes in contact with or pushes the switch 43, whereby the switch 43 is turned on.

Furthermore, the support shaft 45 attached to the first rotating disk 21 so as to project from the rear face thereof is provided with a swingable guide swing lever 46. The swing end portion is provided with a guide notch 46*a* opening outward. The two outside edges of the swing end portion 46*b* are curved. The middle region of the guide swing lever 46 is provided with a long aperture 46*c* extending in the swing direction. The long aperture 46*c* has inserted in it a stopper pin 47 which is secured to the first rotating disk 21 and projects from the rear face thereof.

Figure 9:
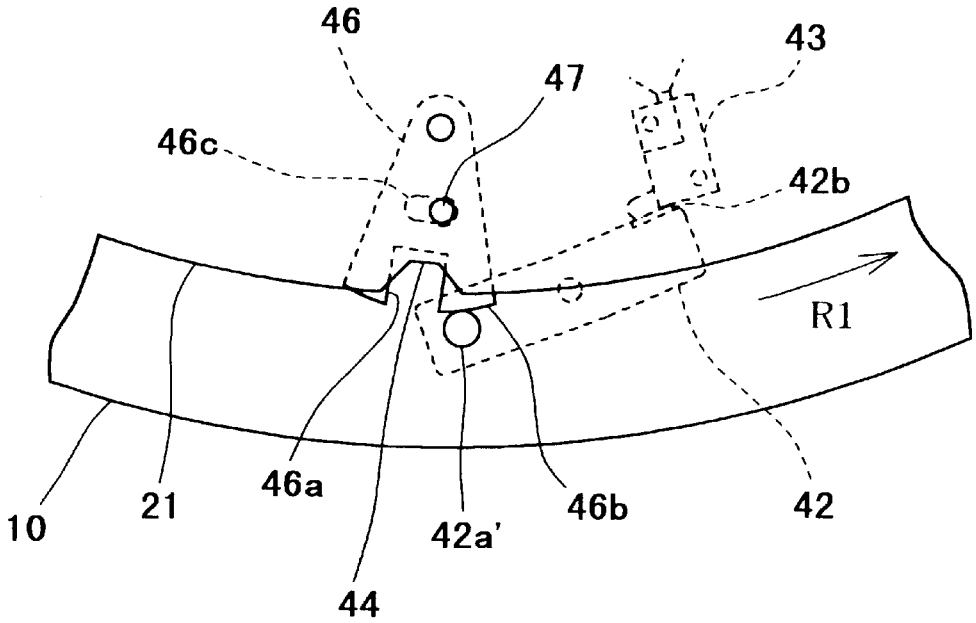
FIGS. 9 to 12 are front views of the detecting means shown in FIG. 8 in the state of operation.
Figure 10:
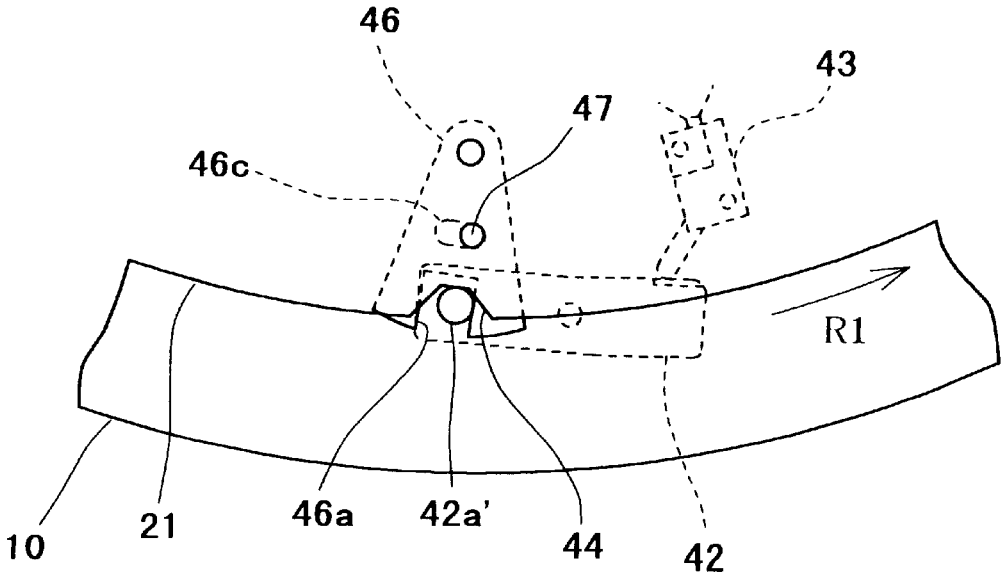

Namely, as shown in FIG. 9, when the first rotating disk 21 rotates in the R1 direction and the contact pin 42*a*' of the swing arm 42 approaches the concavity 44, the contact pin 42*a*' first comes in contact with the right side of the swing end portion 46*b* of the guide swing lever 46, thereby turning the guide swing lever 46 in the reverse direction to the RI direction. After this motion, when the right side face of the long aperture 46*c* comes in contact with the stopper pin 47 and more swing motion of the guide swing lever 46 is inhibited, the contact pin 42*a*' rides on the outer circumference of the right side swing end portion 46*b*. When the first rotating disk 21 rotates more, as shown in FIG. 10, the contact pin 42*a*' separates from the right side swing end portion 46*b*, is guided by the guide notch 46*a*, and enters the center portion of the concavity 44.

Figure 11:
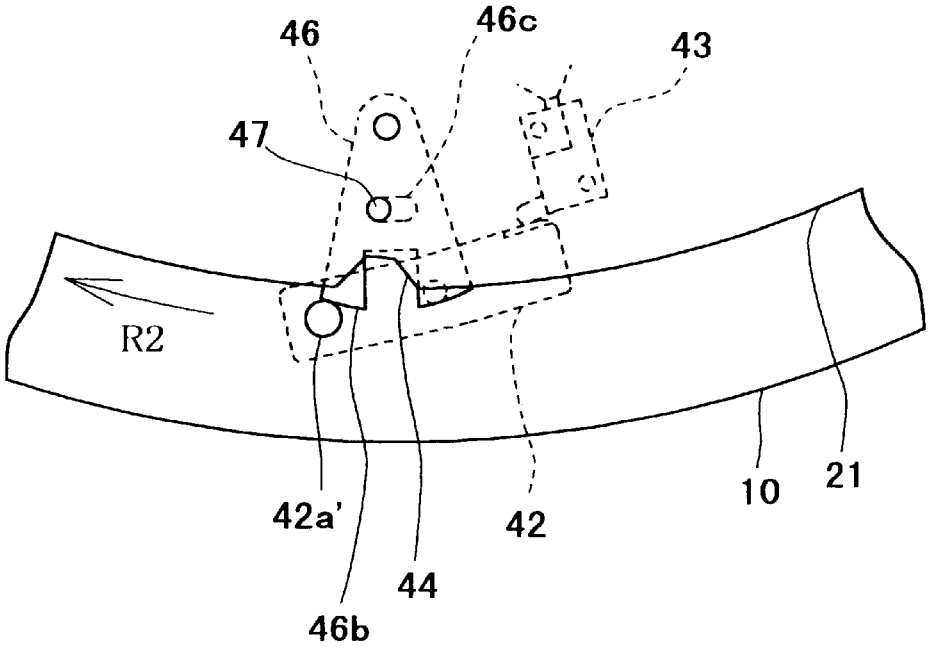
Figure 12:
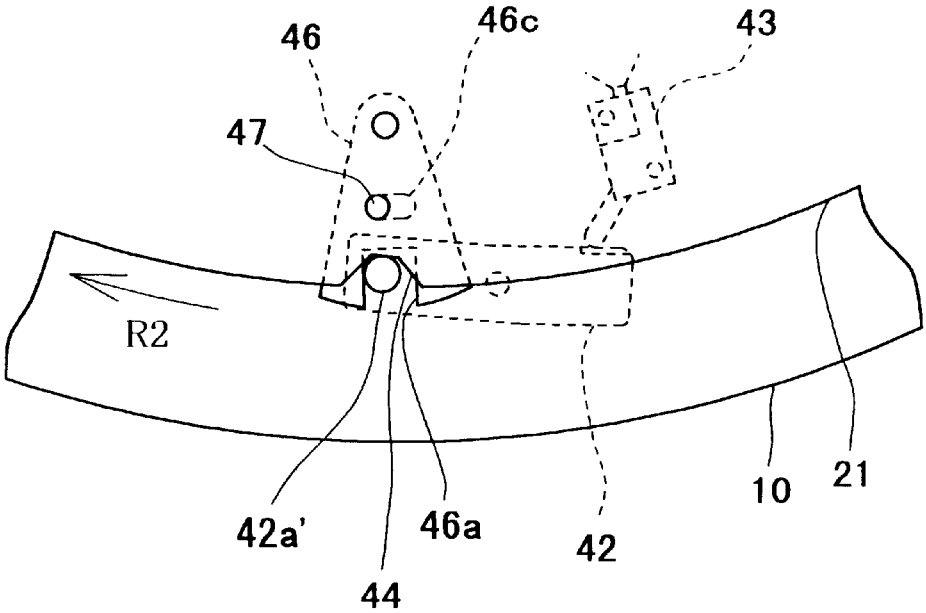

On the other hand, as shown in FIG. 11, when the first rotating disk 21 rotates in the R2 direction and the contact pin 42*a*' of the swing arm 42 approaches the concavity 44, as mentioned above, the contact pin 42*a*' first comes in contact with the left side swing end portion 46*b* of the guide swing lever 46, thereby turning the guide swing lever 46 in the reverse direction to the R2 direction. After this motion, when the left side face of the long aperture 46*c* comes in contact with the stopper pin 47 and more swing motion of the guide swing lever 46 is inhibited, the contact pin 42*a*' rides on the outer circumference of the left side swing end portion 46*b*. When the first rotating disk 21 rotates more, as shown in FIG. 12, the contact pin 42*a*' separates from the left side swing end portion 46*b*, is guided by the guide notch 46*a*, and enters the center portion of the concavity 44.

As described above, the guide swing lever 46 allows the contact pin 42*a*' to enter the center portion of the concavity 44, thereby reliably turning off the switch 43 at a predetermined timing no matter which direction the first rotating disk 21 is rotating in.

The combination of the swing arm 42, the contact pin 42*a*' provided on one end 42*a* of the swing arm 42, the tapered concavity 44 serving as a contact portion, and the switch 43 controlling the on/off state of the motor 25 comprises a detecting means 40 which detects if the first rotating disk 21 serving as the rotating member or the cover, namely, the dial plate 6 (6*a* and 6*b*) has reached a predetermined angular position or has been moved from the home position of the closed state to an operating position of the open state and then again returned to the home position.

Furthermore, the combination of the swing arm as described above, the contact pin, the tapered concave, the switch, etc. may be provided separately and form a detecting means which detects if the dial plate 6 (6*a* and 6*b*) has rotated and revolved, for example, through an angle of 180 degrees, namely, has reached the position wherein the dial plate 6 is most opened. The motor 25 may be stopped in this state to hold the open state. This allows one operating mode of the trick action type clock, namely the state where the ornaments 7 have appeared, to be clearly displayed when displaying the clock to consumers.

Figure 13:
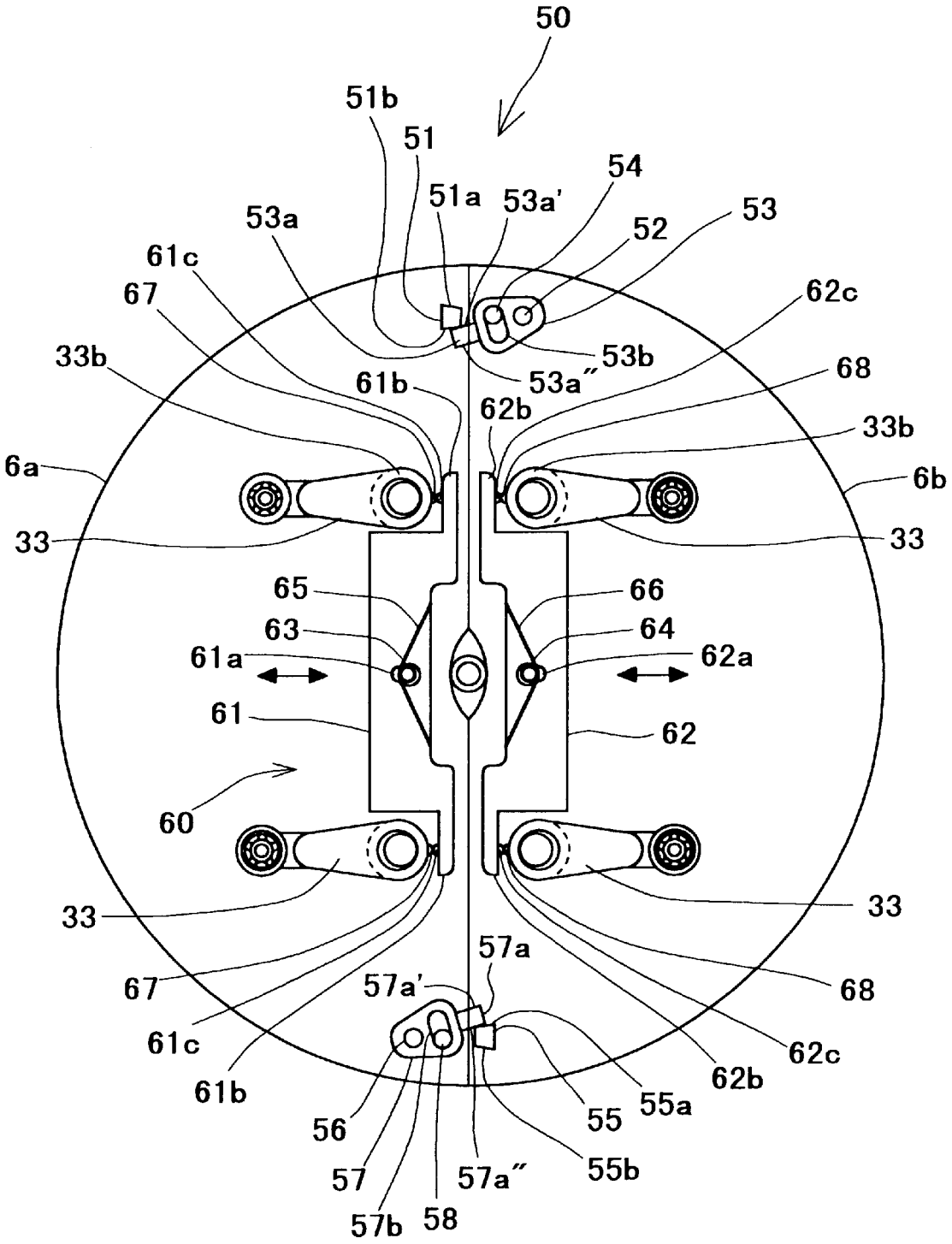
FIG. 13 is a front view of a positioning means in the trick action type clock of the present invention.

As shown in FIG. 13, the left side dial plate 6*a* of the dial plate 6 is firmly provided with a first stopper 51 projecting rearward at an upper region of the rear face thereof near to the mating surface. On the other hand, the right side dial plate 6*b* of the dial plate 6 is provided with a swingable first positioning lever 53 at a support shaft 52 projecting rearward at an upper region of the rear face thereof near to the mating surface. Further, a contact portion 53*a* is formed at the swing end side of the first positioning lever 53, a long aperture 53*b* extending in the swing direction is formed at a middle region of the first positioning lever 53, and a stopper pin 54 projecting from the rear face of the right side dial plate 6*b* is loosely inserted into the long aperture 53*b* to limit the swing motion of the first positioning lever 53 to within a predetermined range.

Further, as shown in FIG. 13, the right side dial plate 6*b* of the dial plate 6 is firmly provided with a second stopper 55 projecting rearward at a lower region of the rear face near the mating surface. On the other hand, the left side dial plate 6*a* of the dial plate 6 is provided with a swingable second positioning lever 57 at a support shaft 56 projecting rearward at a lower region of the rear face near the mating surface. Furthermore, a contact portion 57*a* is formed at the swing end side of the second positioning lever 57, a long aperture 57*b* extending in the swing direction is formed at a middle region of the second positioning lever 57, and a stopper pin 58 projecting from the rear face of the left side dial plate 6*a* is loosely inserted into the long aperture 57*b* to limit the swing motion of the second positioning lever 57 to within a predetermined range.

In the above configuration, when drive mechanism is actuated and the left side dial plate 6*a* and the right side dial plate 6*b* are driven to rotate in the clockwise direction in FIG. 13, when the dial plates 6*a* and 6*b* travel from the home position of the closed state to the operating position of the opened state and then again approach the home position of the closed state, as shown in FIG. 13, the lower face 51*b* of the first stopper 51 comes in contact with the upper face 53*a*' of the contact portion 53*a* of the first positioning lever 53, and the upper face 55*a* of the second stopper 55 comes in contact with the lower face 57*a*" of the contact portion 57*a* of the second positioning lever 57. After this, the left side dial plate 6*a* and the right side dial plate 6*b* are positioned with respect to each other at the position wherein the upper face of the long aperture 53*b* and the lower face of the long aperture 57*b* are in contact with the stopper pins 54 and 58, namely, the position where the mating surfaces of the left and right side dial plates 6*a* and 6*b* mate in the vertical direction.

Further, in the above configuration, when the foregoing drive means is driven and the left side dial plate 6*a* and the right side dial plate 6*b* are driven to rotate in the counter-clockwise direction in FIG. 13, when the dial plates 6*a* and 6*b* travel from the home position of the closed state to the operating position of the opened state and approach the home position of the closed state again, the upper face 51*a* of the first stopper 51 comes in contact with the lower face 53*a*" of the contact portion 53*a* of the first positioning lever 53 and the lower face 55*b* of the second stopper 55 comes in contact with the upper face 57*a*' of the contact portion 57*a* of the second positioning lever 57. After this, the left side dial plate 6*a* and the right side dial plate 6*b* are positioned with respect to each other at the position where the lower face of the long aperture 53*b* and the upper face of the long aperture 57*b* are in contact with the stopper pins 54 and 58 respectively, namely, the position where the mating surfaces of the left and right side dial plates 6*a* and 6*b* mate with each other in the vertical direction.

The combination of the first stopper 51, the first positioning lever 53, the second stopper 55, and the second positioning lever 57 forms a first positioning means 50 which positions the mating surfaces of the left and right side dial plates 6*a* and 6*b* with respect to each other when the left and right side dial plates 6*a* and 6*b* of the cover return to the home position to enter the closed state.

Further, the left side dial plate 6*a* and the right side dial plate 6*b* are provided on the rear faces thereof at the mating surface regions with two spring-loaded levers 61 and 62 which extend in the vertical direction in the closed state and move back and forth in the horizontal direction. The spring-loaded levers 61 and 62 are provided at the middle regions with long apertures 61*a* and 62*a* extending in the horizontal direction. Guide pins 63 and 64 which project rearward from the left and right side dial plates 6*a* and 6*b* are loosely inserted into the long apertures 61*a* and 62*a* respectively, whereby the spring-loaded levers 61 and 62 are able to move back and forth in the direction of extension of the long apertures 61*a* and 62*a*.

Further, the spring-loaded levers 61 and 62 are provided at both ends with contact portions 61*b* and 62*b* respectively. Contact projections 61*c* and 62*c* are formed at parts of these contact portions 61*b* and 62*b*. On the other hand, contact projections 67 and 68 are integrally formed on the outer circumferential surfaces of the other ends 33*b* of the crank members mentioned above.

Furthermore, springs 65 and 66 are provided between the guide pins 63 and 64 and the spring-loaded levers 61 and 62. The spring-loaded levers 61 and 62 are spring-loaded so that the contact projection 61*c* is in contact with the contact projection 67 and the contact projection 62*c* and contact projection 68 are in contact in the closed state and so that the contact portions 61*b* and 62*b* are in contact with the outer circumferential surfaces of the other ends 33*b* in states other than the closed state.

Namely, since there is some clearance in the connected state between the connecting shafts 6*c* of the left and right side dial plates 6*a* and 6*b* and the connecting holes 33*b*' formed at the other ends 33*b* of the crank members 33, particularly in the closed state, the spring-loaded levers 61 and 62 bias the connecting shafts 6*c* so as to absorb the clearance, namely, so as to make the left and right side dial plates 6*a* and 6*b* approach each other, thereby making the mating surfaces closely contact each other so as not to leave a clearance therebetween. Note that the clearance described above is for absorbing manufacturing error in dimensions.

In the above configuration, when the left and right side dial plates 6*a* and 6*b* rotate in the clockwise direction in FIG.

13 and return to the home position of the closed state again, the contact of the contact projections 67 and 61*c* pushes the left side dial plate 6*a* downward, and the contact of the contact projections 68 and 62*c* pushes the right side dial plate 6*b* upward, whereby the two mating surfaces of the left and right side dial plates 6*a* and 6*b* are precisely positioned with respect to each other.

Likewise, when the left and right side dial plates 6*a* and 6*b* rotate in the counterclockwise direction in FIG. 13 and return to the home position of the closed state again, the contact of the contact projections 67 and 61*c* pushes the left side dial plate 6*a* upward and the contact of the contact projections 68 and 62*c* pushes the right side dial plate 6*b* downward, whereby the two mating surfaces of the left and right side dial plates 6*a* and 6*b* are precisely positioned with respect to each other.

The combination of the spring-loaded levers 61 and 62, the springs 65 and 66, the contact projections 61*c* and 62*c*, and the contact projections 67 and 68 forms a second positioning means 60 which positions the two mating surfaces of the left and right side dial plates 6*a* and 6*b* with respect to each other when the left and right side dial plates 6*a* and 6*b* of the cover return to the home position and enter the closed state.

Figure 14:
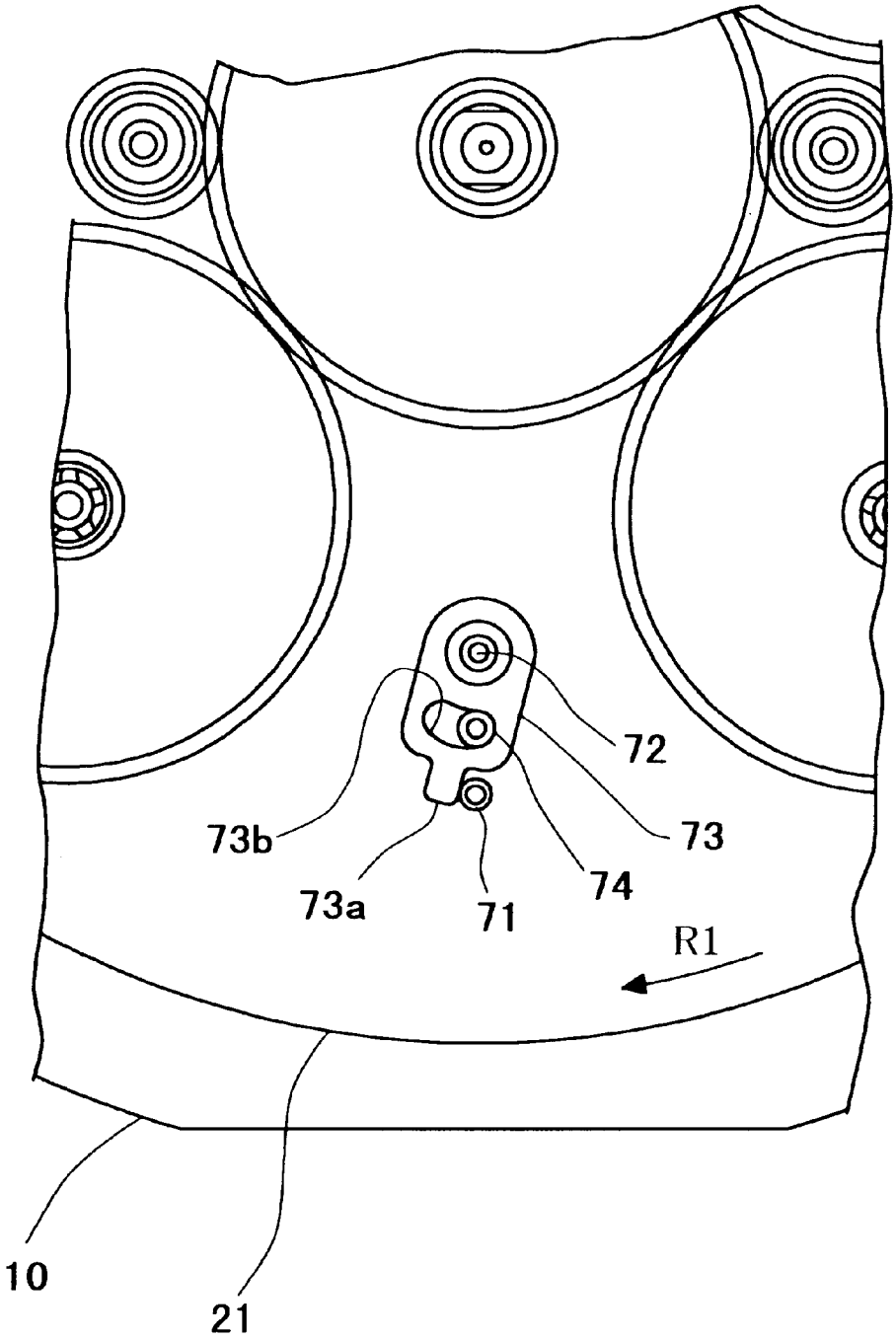
FIG. 14 is a front view of another embodiment of the positioning means.

Further, as shown in FIG. 14, the first rotating disk 21 is provided on the rear face thereof with a stopper pin 71 projecting rearward. The support shaft 72 which is secured on the front face of the fixed disk 10 is swingably provided with a swing lever 73. The swing end side of the swing lever 73 is provided with a contact portion 73*a*. The middle portion of the swing lever 73 is provided with a long aperture 73*b*. A stopper pin 74 secured to the fixed disk 10 is loosely inserted into the long aperture 73*b* to limit the swing motion of the swing lever 73 to within a predetermined range.

Namely, when the first rotating disk 21 rotates in the clockwise direction as shown in FIG. 14 and the dial plate 6 returns to the home position of the closed state, in the home position, the stopper pin 74 abuts against the right side face of the long aperture 73*b* and the stopper pin 71 abuts against the right side face of the contact portion 73*a* of the swing lever 73 kept from swinging any more, whereby the first rotating disk 21 is prevented from rotating more. This allows the first rotating disk 21, namely, the dial plate 6, to stop at the home position precisely.

On the other hand, when the first rotating disk 21 rotates in the counterclockwise direction in FIG. 14 and the dial plate 6 returns to the home position of the closed state, in the home position, the stopper pin 74 abuts against the left side face of the long aperture 73*b* and the stopper pin 71 abuts against the left side face of the contact portion 73*a* of the swing lever 73 kept from swinging further, whereby the first rotating disk 21 is prevented from rotating more. This allows the first rotating disk 21, namely the dial plate 6, to stop at the home position precisely.

Next, the operation of the clock according to the present embodiment will be described hereinbelow.

Figure 15:
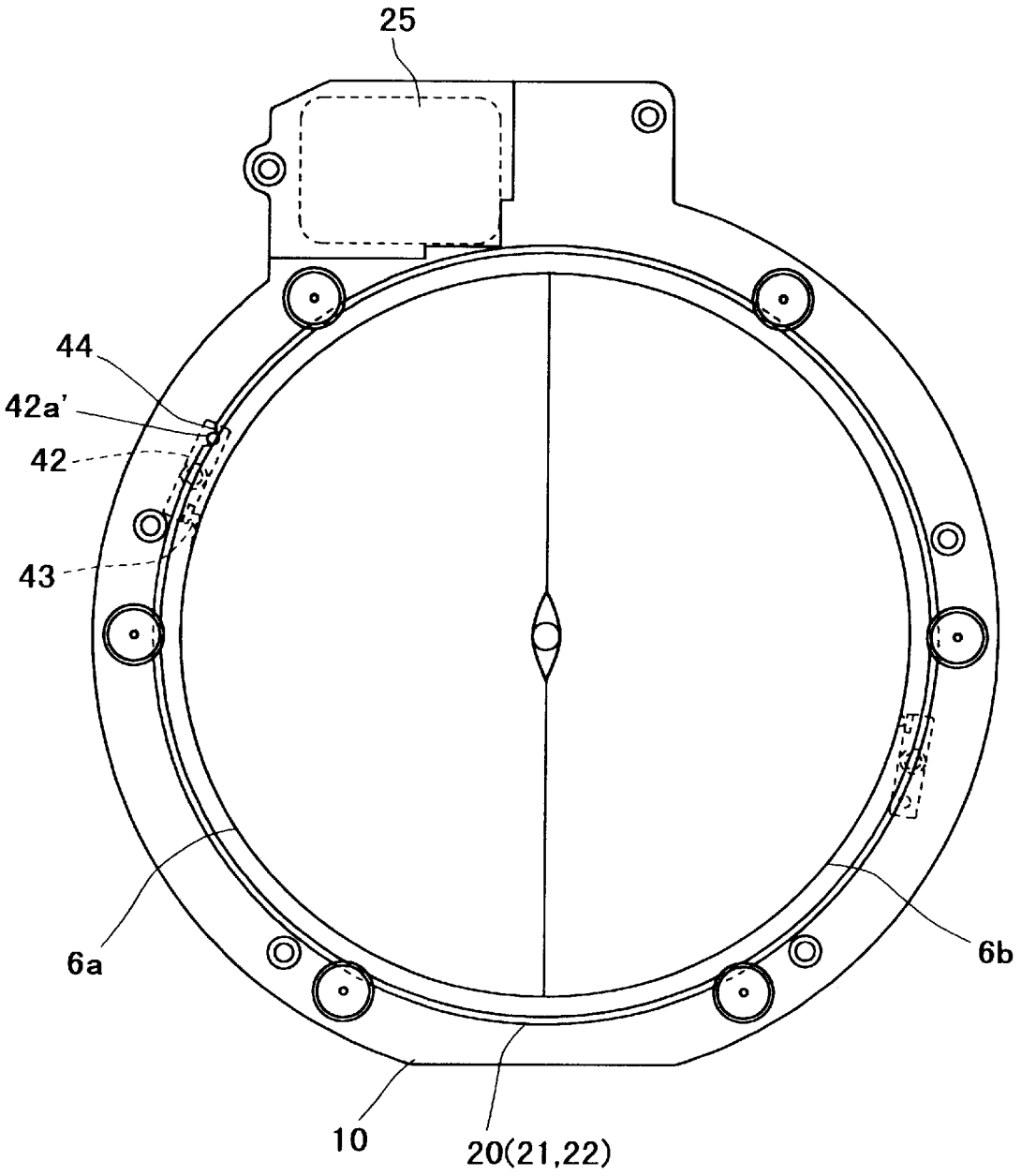
FIG. 15 is a front view of a dial plate in a closed state, that is, a home position.

As shown in FIG. 15, when a predetermined time, for example, noon, arrives in the state in which the dial plate 6 (6*a* and 6*b*) is in the closed state, that is, the home position, a controller (not shown) sends a drive signal to the motor 25 and the motor 25 rotates in one direction, whereby the driven gear 24 and the rotating disk 20 (21 and 22) start to rotate, for example, in the clockwise direction in FIG. 15 through the gear train 26.

This clockwise rotation of the rotating disk 20 allows the planetary gears 31 to revolve around the sun gear 30 while rotating and likewise allows the crank members 33 to revolve while rotating in the clockwise direction. This clockwise rotation of the crank members 33 allows the right side dial plate 6*b* to revolve around the shaft 5 while rotating in the clockwise and downward direction and the left side dial plate 6*a* to revolve around the shaft 5 while rotating in the clockwise and upward direction.

Figure 16:
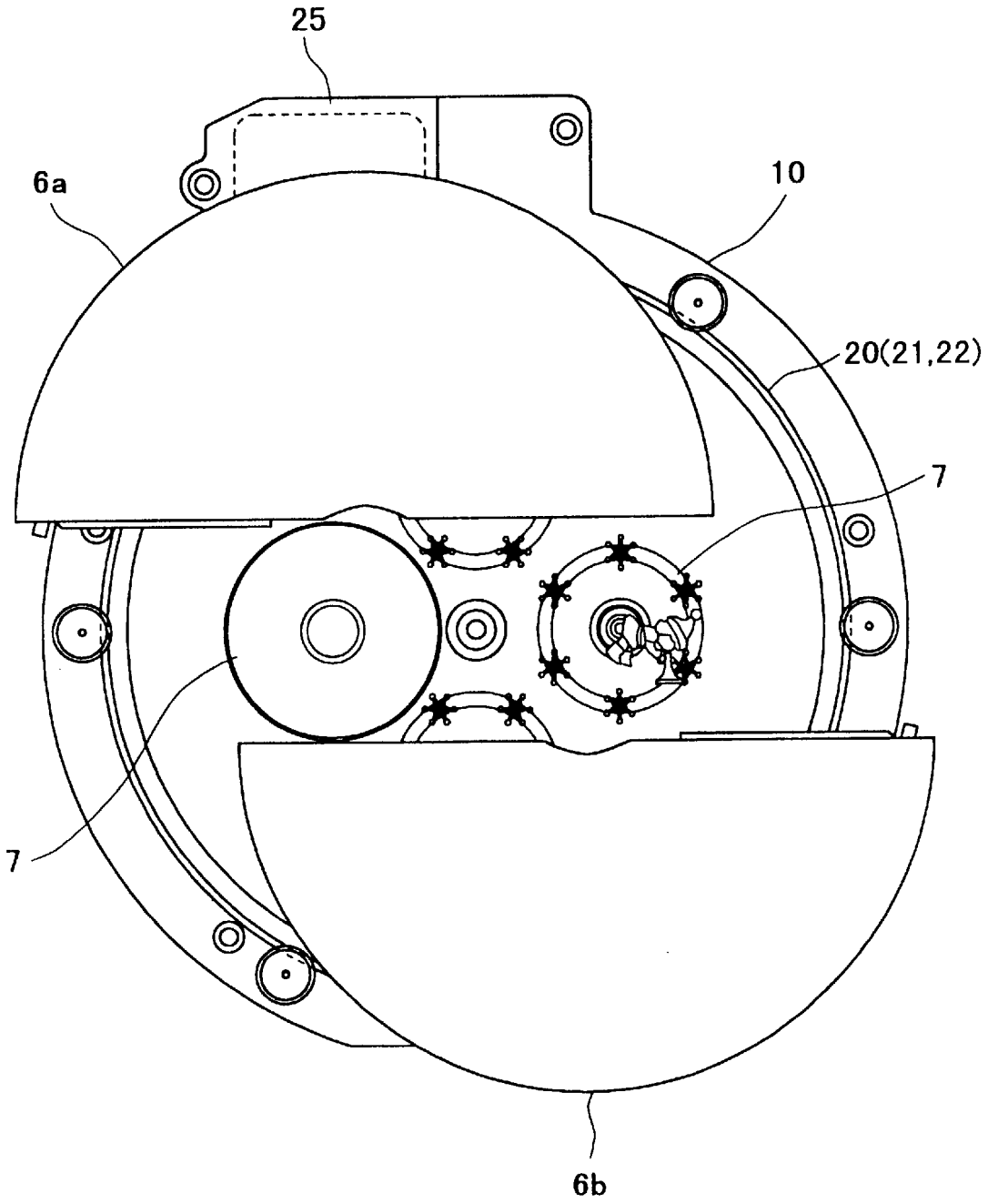
FIG. 16 is a front view of a dial plate in an operating state where the dial plate has revolved through an angle of 90 degrees.

When having revolved through an angle of 90 degrees, as shown in FIG. 16, the right side dial plate 6*b* is positioned at a lower side turned sideways, while the left side dial plate 6*a* is positioned at upper side turned sideways. This puts the dial plate 6 in a half-opened state and causes the ornaments 7 concealed behind it to start appearing. At this stage, the clockwise rotation of the ornament-use gears 32 allows the ornaments 7 to revolve around the shaft 5 in the clockwise direction while rotating in the clockwise direction.

Figure 17:
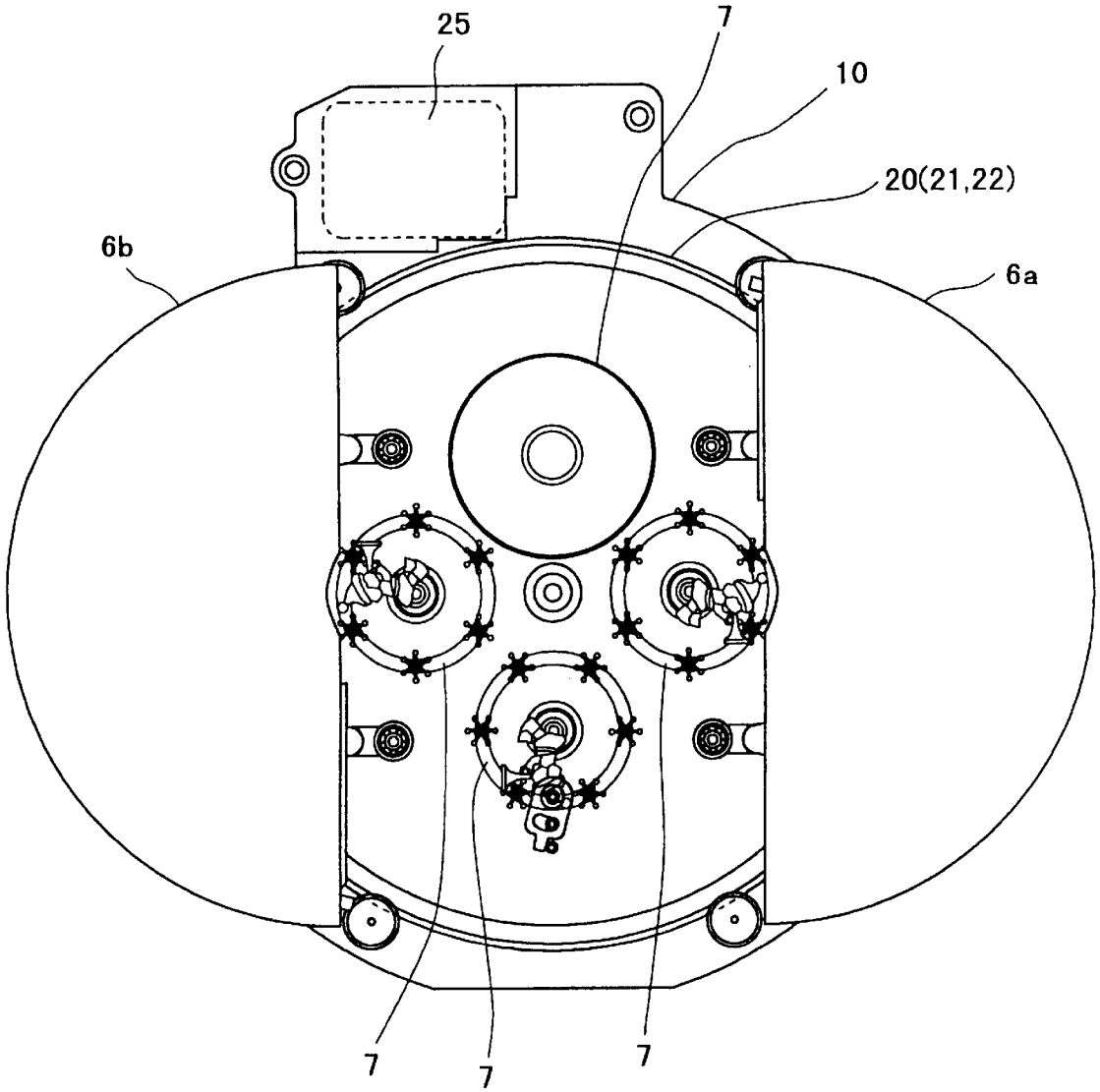
FIG. 17 is a front view of a dial plate in an operating state where the dial plate has revolved through an angle of 180 degrees.

Next, when the rotating disk 20 is rotated more and the dial plate 6 arrives at a position revolved through an angle of 180 degrees, as shown in FIG. 17, the right side dial plate 6*b* is positioned at the left side turned upside down while the left side dial plate 6*a* is positioned at the right side turned upside down. The ornaments 7 concealed behind them therefore appear in their entirety. At this stage, in the same way as explained above, the ornaments 7 revolve around the shaft 5 in the clockwise direction while rotating in the clockwise direction.

When the rotating disk 20 rotates further and the dial plate 6 revolves further to close to 360 degrees, the left and right side dial plates 6*a* and 6*b* approach and contact each other. At this stage, the first positioning means 50 comprising the first stopper 51, the first positioning lever 53, the second stopper 55, and the second positioning lever 57 positions the two mating surfaces of the left and right side dial plates 6*a* and 6*b* with respect to each other.

Further, at the same time, the second positioning means 60 comprising the spring-loaded levers 61 and 62, the springs 65 and 66, the contact projections 61*c* and 62*c*, and the contact projections 67 and 68 pushes down the left side dial plate 6*a* while pushes up the right side dial plate 6*b*. Accordingly, the two mating surfaces are precisely positioned by the first positioning means 50.

Furthermore, as the dial plate 6 turns through an angle of 360 degrees, the detecting means 40, namely the contact pin 42*a*' of the swing arm 42, enters the tapered concavity 44 of the first rotating disk 21 to turn off the switch 43 and to stop the operation of motor 25.

At this time, the left and right side dial plates 6*a* and 6*b* are precisely positioned by the first and second positioning means 50 and 60 and the stopper pin 71 of the first rotating disk 21 is in contact with the contact portion 73*a* of the swing lever 73 on the fixed disk 10 to prevent the first rotating disk 21 from rotating more, whereby the dial plate 6 is positioned at the home position and kept there.

The opening and closing motion of the dial plate 6 at a predetermined time, for example, 12 noon, may be finished at the above-mentioned stage or at the stage where the dial plate 6 rotates in the counterclockwise direction after the above clockwise rotation and has returned to the home position again. This counterclockwise rotation motion is basically the same to the foregoing clockwise rotation motion. Therefore, the explanation of the counterclockwise rotation motion is omitted from here.

In the embodiment explained above, the dial plate 6 was comprised of two mating parts, but the invention is not limited to this. For example, the dial plate 6 may be comprised of four mating parts further mating in the horizontal direction and each mating part may be connected to a crank member 33 and a second crank member 34.

Furthermore, in a trick action type clock according to another embodiment of the present invention, a second cover may be arranged away from the foregoing dial plate. The second cover may be formed by a plurality of mating parts mating along a line passing through a second axis of a predetermined axis arranged parallel to the foregoing center of rotation axis, i.e., the shaft 5 of the hands 4, and openable from and closeable to the second axis. The second cover may be driven by a drive means like the foregoing drive means, namely, one which drives the mating parts to make them rotate and revolve around the second axis to produce an opening and closing motion. Further, a plurality of ornaments may be arranged behind the second cover and moved by a planetary mechanism as mentioned before.

In the above embodiment, when a predetermined time, for example, 12 noon, arrives, the drive means drives the second cover and the mating parts rotate and revolve around the second axis to produce an opening and closing motion.

Summarizing the effects of the present invention, in the trick action type clock of the present invention, when a predetermined time, for example, 12 noon, arrives, the dial plate or cover rotates and revolves around a predetermined axis or the center of rotation of the hands to produce an opening and closing motion and ornaments etc. concealed behind it are made to appear. Therefore, the trick action type clock is increased in the surprise of the change and gives a superior aesthetic impact.

In the above-mentioned trick action type clock, further, when the drive means for driving the dial plate or the cover is comprised of a sun gear, planetary gears, connection members, support member, drive motor, etc., it is possible to arrange the parts closely around a predetermined axis or center of rotation (i.e., shaft) of the hands so it is possible to reduce the size of the clock body in the radial direction.

Further, in the above-mentioned trick action type clock, when ornament-use gears are used, it is possible to make the ornaments appearing upon opening and closing of the dial plate or cover to rotate and revolve around a predetermined axis or the center of rotation of the hands, whereby the ornaments and further the clock can give an excellent impression.

Furthermore, in the above-mentioned trick action type clock, when the connection member is a crank member, the crank member enables enough space to be secured between the dial plate or the cover and the support member, whereby the ornaments can be easily arranged in the space.

It will be further understood by those skilled in the art that the foregoing description refers to a preferred embodiment of the present invention and that various changes and modifications may be made in the present invention without departing from the spirit and scope thereof.

What is claimed is:

1. A trick action type clock comprising:

long and short hands;

a movement for moving said hands;

a dial plate formed by a plurality of parts mating along a line passing through a center of rotation of said hands and arranged to be openable from and closeable to said center of rotation; and a drive means for driving said parts to make them rotate and revolve around said center of rotation to produce an opening and closing motion.

2. A trick action type clock as set forth in claim 1, wherein said drive means includes:

a sun gear fixed immovably to a housing coaxially with said center of rotation;

a plurality of planetary gears engaging with said sun gear;

a plurality of connection members fixed to centers of rotation of said planetary gears at one end and rotatably connected to said mating parts at the other end away from said centers of rotation;

a support member arranged rotatably on said center of rotation and supporting said planetary gears rotatably; and a drive motor for making said support member rotate on said center of rotation.

3. A trick action type clock as set forth in claim 1, wherein said drive means includes:

a sun gear fixed immovably to a housing coaxially with said center of rotation;

a plurality of planetary gears engaging with said sun gear;

a plurality of connection members fixed to centers of rotation of said planetary gears at one end and rotatably connected to said mating parts at the other end away from said centers of rotation;

a support member arranged rotatably on said center of rotation and supporting said planetary gears rotatably; and a drive motor for making said support member rotate on said center of rotation and wherein further comprising:

a plurality of ornaments arranged behind said dial plate and a plurality of ornament-use gears rotatably supported on said support member while engaging with said sun gear for moving said ornaments.

4. A trick action type clock as set forth in claim 1, wherein said drive means includes:

a sun gear fixed immovably to a housing coaxially with said center of rotation;

a plurality of planetary gears engaging with said sun gear;

a plurality of connection members fixed to centers of rotation of said planetary gears at one end and rotatably connected to said mating parts at the other end away from said centers of rotation;

a support member arranged rotatably on said center of rotation and supporting said planetary gears rotatably; and a drive motor for making said support member rotate on said center of rotation and said connection members are crank members having steps in an axial direction of said center of rotation.

* * * * *